US005761859A

United States Patent [19]

Duda

[11] Patent Number: 5,761,859

[45] Date of Patent: Jun. 9, 1998

[54] INTERCONNECTED DOOR JAMB BRICK

[75] Inventor: Kevin J. Duda, Wexford, Pa.

[73] Assignee: Harbison-Walker Refractories Company, Dallas, Tex.

[21] Appl. No.: 658,971

[22] Filed: Jun. 4, 1996

[51] Int. Cl.[6] ..... E06B 1/24; F23M 7/02

[52] U.S. Cl. ..... 52/204.1; 52/568; 52/585.1; 52/606; 52/610; 52/745.1; 110/173 R; 176/190

[58] Field of Search ..... 52/585.1, 568, 52/745.1, 606, 610, 204.1; 110/173 R; 126/190

[56] References Cited

U.S. PATENT DOCUMENTS

| | | | |
|---|---|---|---|
| 555,693 | 3/1896 | Geraerdts | 52/585.1 |
| 921,114 | 5/1909 | Hudson | 52/585.1 |
| 1,021,851 | 4/1912 | Strale . | |
| 1,459,808 | 6/1923 | Wall | 110/173 R |
| 1,737,239 | 11/1929 | Himmelright . | |
| 2,122,696 | 7/1938 | Poston . | |
| 2,144,598 | 1/1939 | Brinckerhoff et al. . | |
| 2,472,221 | 6/1949 | Malthouse . | |
| 2,611,330 | 9/1952 | Kirk | 52/745.1 X |
| 3,780,484 | 12/1973 | Muse . | |
| 5,007,218 | 4/1991 | Bengston et al. | 52/204.01 |

FOREIGN PATENT DOCUMENTS

| | | |
|---|---|---|
| 0066566 | 12/1982 | European Pat. Off. . |

*Primary Examiner*—Christopher Kent
*Attorney, Agent, or Firm*—Craig G. Cochenour; John L. Sigalos

[57] ABSTRACT

Refractory door jamb assemblies for high temperature furnaces. The door jamb assemblies include alternating courses of refractory brick shapes, selected ones of which are fitted with apertures that are aligned as by drilling, when the bricks are installed. One or more steel rods are inserted through the aligned apertures to fasten and retain the bricks in the desired position so as to cooperatively act with the bricks and prevent them from moving when subjected to thermal and mechanical forces encountered in use.

23 Claims, 5 Drawing Sheets

INTERCONNECTED DOOR JAMB BRICK

BACKGROUND OF THE INVENTION

This relates to improved structural stability of refractory shapes which are used in the construction of doorways especially adapted for providing access to electric arc furnaces employed in making steel.

One problem heretofore encountered with high temperature refractories resides in the characteristics of the materials employed to hold them in place. The extreme temperature changes to which such refractories are subjected exacerbate the problems associated with refractory brick retainment; and thus, it has been proposed in U.S. Pat. No. 2,144,598 to use restraining rods to hold uniformly shaped interior lining refractories in position within independently replaceable and removable panel units adapted for mounting within upper sections of generating station boilers.

High temperature refractory doorways for steel-making furnaces have heretofore been proposed and are generally known and used in furnaces such as those of the electric arc type. However, the life expectancies of such doorways has typically been only a fraction of the corresponding life expectancies of the interior linings of such furnaces. As an illustration, the life expectancies of conventional electric arc furnace doorways is approximately 150 heats but such doorways may require repair or replacement after as few as 10 heats. In contrast therewith, the typical life expectancies of the adjacent interior linings are from 100 to 1,000 heats with 300 to 500 being typical.

It will be recognized by those skilled in the art that substantial expense is incurred when a furnace is shut down for maintenance and/or repair. For major repairs, a furnace must be permitted to cool completely before doorways can be replaced, and there is a substantial loss of time, productivity and cost incurred each time a doorway must be repaired/replaced. Most often, door jambs are repaired by hot gunning which also involves extra labor and lost production. Hot patches are rarely as durable as brick repairs and additional patching will be required at frequent intervals. Accordingly, it is important that life expectancies of furnace doorways be extended to levels more comparable with those of the adjacent interior linings.

Damage to electric arc furnace doorways is caused by various activities including charging, cleaning/removal of buildup, insertion, operation and removal of injection lances. Brick may be cracked or dislodged by exposure to thermal shock, impact or general mechanical abuse, thus necessitating expensive and time-consuming repairs.

It has been found that damage to electric arc furnace doorways has often been caused by the inevitable impact from equipment that is used to clean the door jambs, repair the refractory lining, remove slag and/or add ingredients to the furnace. Such impact has, in the past, often dislodged, fractured or otherwise damaged individual refractory bricks or other members, thus necessitating expensive and time-consuming repairs.

BRIEF SUMMARY OF THE INVENTION

The improved door jambs according to the invention include a plurality of different predetermined shapes that are successively positioned in layers through which at least one set of aligned apertures are extended so as to receive one or more through bolts that are employed: (1) to ensure correct positioning of the layered refractories; and (2) to assist in preventing the refractories from being dislodged during use.

In an alternate embodiment, other metallic members are positioned in cooperative relationship with the bolts to assist in strengthening the refractory assemblies; in another aspect, selected refractories may be covered at least in part by steel to facilitate attachment to an exterior shell; and in still another, sub-assemblies may be preformed in modules.

OBJECTS AND FEATURES OF THE INVENTION

It is one general object of the invention to increase the life of high temperature refractory doorways.

It is another object of the invention to reduce maintenance costs for high temperature refractory doorways.

It is yet another object of the invention to reduce damage and down time for high temperature refractories resulting from collisions by materials handling equipment.

Accordingly, in accordance with one feature of the invention, pluralities of individual refractory bricks are assembled into interleaving course arrangements thereby simplifying installation.

In accordance with another feature of the invention, the aforementioned course arrangements may be pre-assembled in successive layers thus facilitating installation.

In accordance with still another feature of the invention, an in-line aperture is provided through refractories in each course arrangement, thus facilitating positioning and alignment of successive layers.

In accordance with still another feature of the invention, a fastening rod is installed within such aligned apertures to ensure correct positioning, to add strength to the composite structure and to reduce dislodgement or damage of the refractories when in use.

In accordance with yet another feature of the invention, in alternative embodiments, auxiliary metallic members such as straps are disposed in cooperative relationship with the aforementioned fastening rod to add strength to the refractory assemblies.

In accordance with another feature of the invention, selected refractories may be wholly or partly covered with steel to facilitate attachment to an exterior shell.

In accordance with still another feature of the invention, the aforementioned fastening rods are affixed to external anchors to secure the courses of refractories in position, thus imparting added strength to the composite structure.

These and other objects and features of the invention will be apparent from the following description, by way of example of a preferred embodiment, with reference to the drawing.

DESCRIPTION OF A PREFERRED EMBODIMENT

Figure 1:
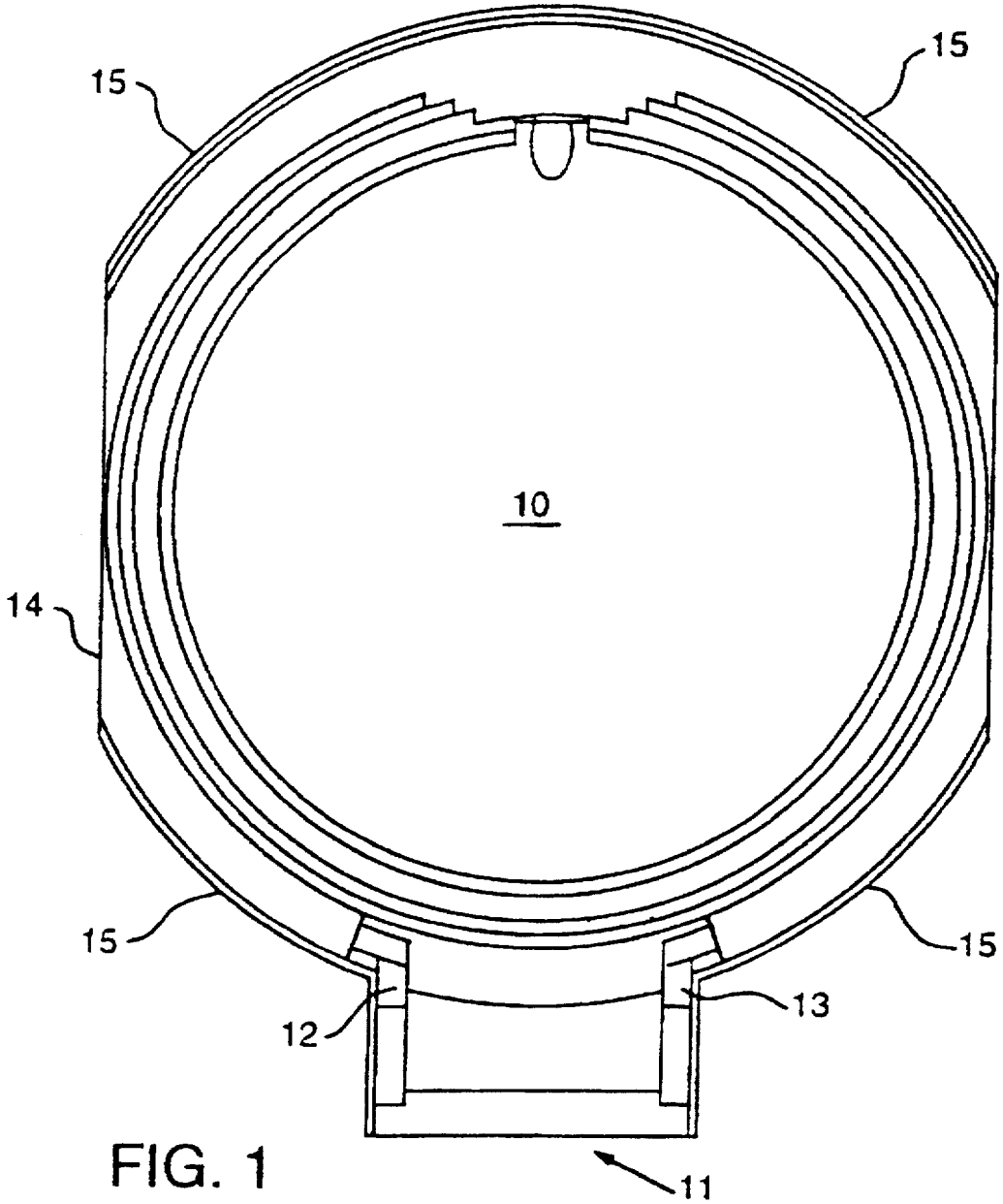
FIG. 1 is top sectional view depicting an electric arc steel-making furnace having a doorway constructed in accordance with the invention.

Now turning to the drawing, and more particularly FIG. 1 thereof, it will be seen that there is generally depicted a high temperature furnace 10 having a doorway 11 through which scrap and other conventional steel making materials may be introduced into the interior for melting and processing. In addition, some refractory repairs may be effected through the door which is also used for slag removal. Not shown is a conventional closing member for closing doorway 11.

Surrounding doorway 11 are courses of refractories which present surfaces such as door jambs 12 and 13 that are exposed and therefore vulnerable to damage by unintentional contact from equipment and/or materials being communicated to or from the furnace during its operation or during repairs. Extending about the interior of the furnace 10 are conventional refractory walls 14 contained within a conventional protective exterior steel case 15.

As mentioned above, FIG. 2 is a front elevation view illustrating the left door jamb 12 of the doorway 11 of FIG. 1. There, are seen four courses of refractories which are disposed vertically and which are identified in ascending order as Crse 1L, Crse 2L, Crse 3L and Crse 4L respectively. These courses are alternated, with course 2L and 4L being in similar configuration; and course 1L and 3L being similar to each other but different than courses 2L and 4L. As a consequence, the end surfaces 2SL and 4SL are recessed from the adjacent corresponding surfaces 1SL and 3SL, thus providing for convenient interlocking with abutting refractory bricks (not shown) that comprise the principal refractory wall 14 of the furnace 10.

Extending in vertical alignment through courses 1L, 2L, 3L and 4L are aligned apertures 16 which are preferably drilled through the courses of refractory material after the refractories have been assembled or set in place. As mentioned above, a fastening rod such as rod 17 of FIG. 3 is installed within such aligned apertures to ensure correct positioning, to add strength to the composite structure, to provide for anchoring, and to reduce dislodgement or damage of the refractories when in use. As described below, at least one end of the rod is fastened to a plate that provides for frictional engagement with a major surface of one of the refractories so that tightening the rod as by use of conventional means such as a nut (not shown but which may be fitted within recess 16*a* of FIG. 2 if brick are pre-drilled before installation) applies frictional force between surfaces of the refractories to assist retaining them in place. The remaining end of the rod may be affixed to any suitable anchoring point to prevent lateral movement of the refractories.

As mentioned above, FIG. 3 is a plan view of the left door jamb. There, looking down from above on the assembly shown in FIG. 2 one will immediately observe the uppermost course 4L/4SL which comprises refractories 23, 24 and 25. Then, projecting outwardly from beneath uppermost course 4L/4SL is the exposed surface portion of refractory 20*a*.

Figure 2:
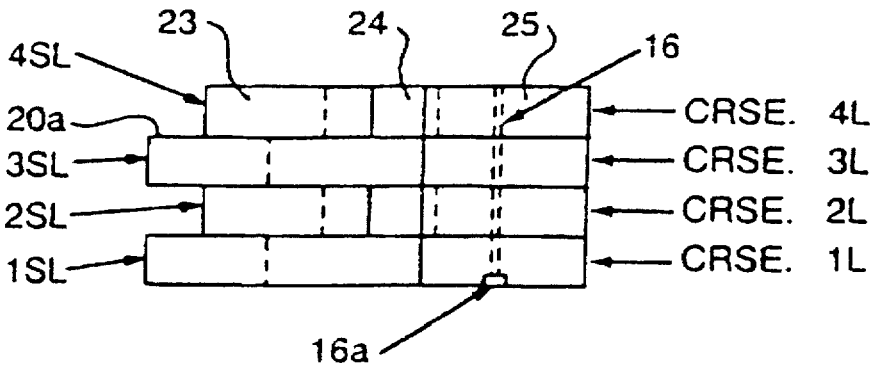
FIG. 2 is a front elevation view illustrating the left door jamb of a doorway constructed in accordance with the invention.
Figure 4B:
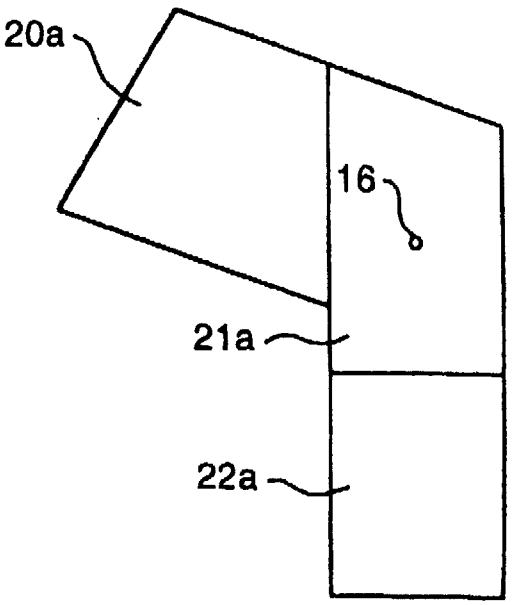
FIG. 4B is a top view of a course assembly for course 3 of the left door jamb of FIG. 2.
Figure 5:
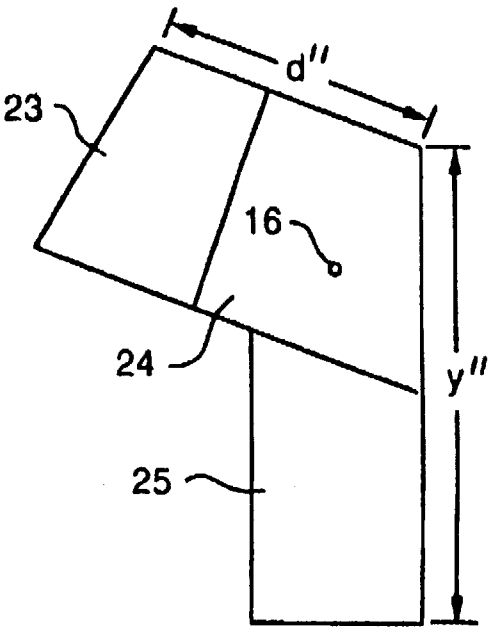
FIG. 5 is a top view of a course assembly for courses 2 and 4 of the left door jamb of FIG. 2.
Figure 4A:
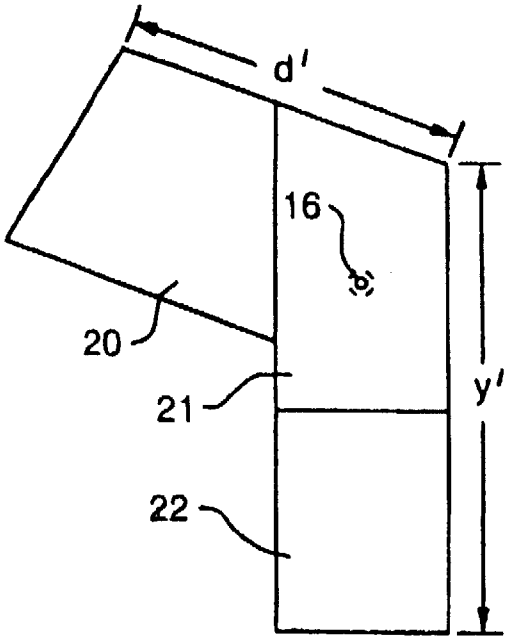
FIG. 4A is a top view of a course assembly for course 1 of the left door jamb of FIG. 2.

FIG. 4A is a top view of a course assembly for course 1 of the left door jamb of FIG. 2, FIG. 4B is a top view of a course assembly for course 3, and FIG. 5 is a top view of a course assembly for courses 2 and 4 of the left door jamb of FIG. 2. Although these course assemblies may be comprised of refractories having shapes differing from those depicted, they preferably are comprised of refractories having shapes as shown to facilitate achievement of the interleaved structure illustrated in FIG. 2. Thus, the dimension d' of the course assemblies of FIGS. 4A and 4B is greater than the corresponding dimension d" of FIG. 5, thus corresponding to the non-planarity of surfaces 3SL/4SL and 1SL/2SL as shown in FIG. 2. On the other hand, the dimensions y' and y" are identical so as to provide for planarity of the vertical co-planar surfaces shown at the right side of FIG. 2.

As will be evident from further inspection of the drawing, each course comprises three shapes. Thus, course 1L (FIG. 4A) comprises shapes 20, 21 and 22; and course 3L comprises similar shapes 20*a*, 21*a* and 22*a*. Course 2L comprises shapes 23, 24 and 25 (FIG. 5); and course 4L comprises shapes like those of course 2L . Thus, when the courses of FIGS. 4A, 4B and 5 are sandwiched together into assemblies such as those of FIG. 2, one set of faces (such as those at the right side of FIG. 2) are co-planar, whereas the opposing set of faces are staggered with offsets so that their surfaces 1SL/3SL (FIG. 2) are non-co-planar with surfaces 2SL/4SL .

The foregoing will be further evident when it is recognized that when the courses of FIGS. 4A, 4B and 5 are overlaid, shape 23 will overlie only part of shape 20*a*; shape 24 will overlie only part of shape 21; and shape 25 will overlie all of shape 22 plus a part of refractory 21.

Figure 6:
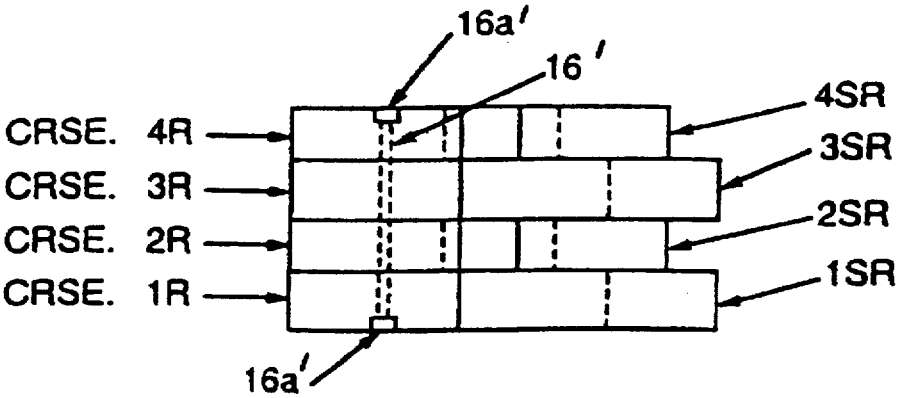
FIG. 6 is a front elevation view illustrating the right door jamb of a doorway constructed in accordance with the invention.

As mentioned above, FIG. 6 is a front elevation view illustrating the right door jamb of a doorway constructed in accordance with the invention. As will be observed from reference to the drawing, FIG. 6 is like FIG. 2 except for being of opposite hand orientation to reflect the fact that it is for the right hand jamb instead of the left hand jamb as described above in connection with FIG. 2 . Accordingly, the above description for FIG. 2 may be applied to FIG. 6 with substitution of corresponding reference characters. Thus , in FIG. 6, reference characters 1SR-4SR correspond to reference characters 1SL–4SL of FIG. 2; courses 1R–4R to courses 1L–4L; apertures 16' to apertures 16; and recess 16*a*' to recess 16*a*.

Figure 3:
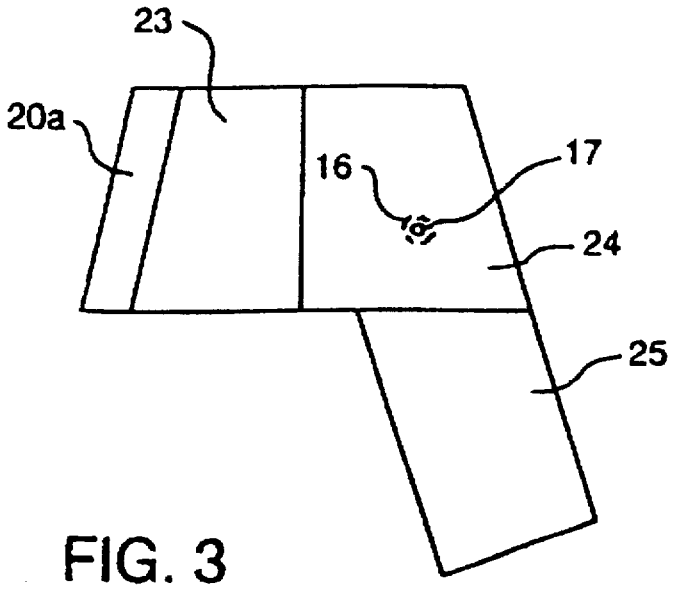
FIG. 3 is a plan view of the left door jamb of FIG. 2.
Figure 7:
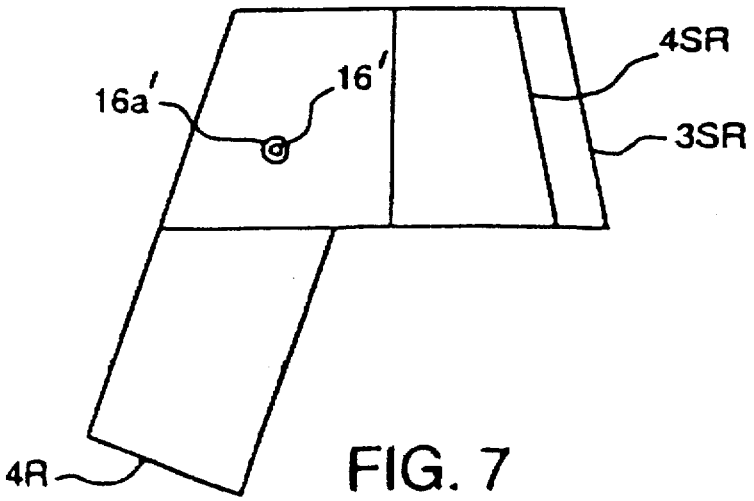
FIG. 7 is a top plan view of a course assembly for course one of the right door jamb of FIG. 6.

FIG. 7 is a top plan view of a course assembly for the right door jamb of FIG. 6. It will be seen to be similar to course one of the left door jamb as illustrated in FIG. 3 except for being of opposite hand and being labelled with reference characters 4R, 4SR and 3SR which, of course, correspond respectively to reference characters 4L, 4SL and 3SL of FIG. 3.

Figure 8B:
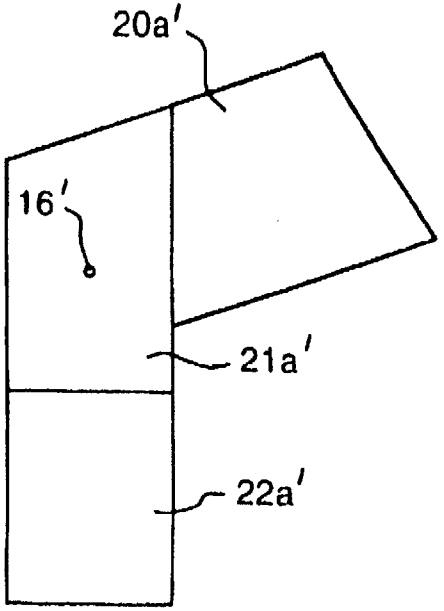
FIG. 8B is a top view of a course assembly for course 3 of the right door jamb of FIG. 6.
Figure 9:
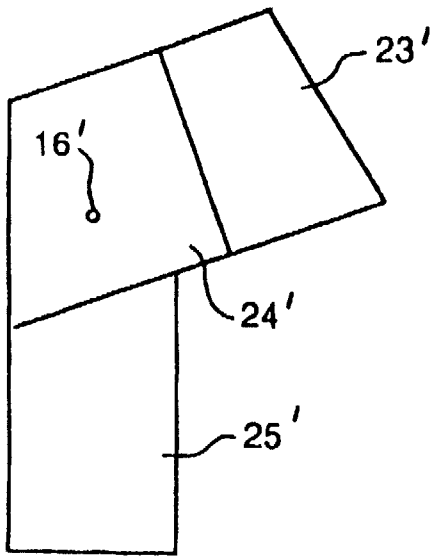
FIG. 9 is a top view of a course assembly for courses 2 and 4 of the right door jamb of FIG. 6.
Figure 8A:
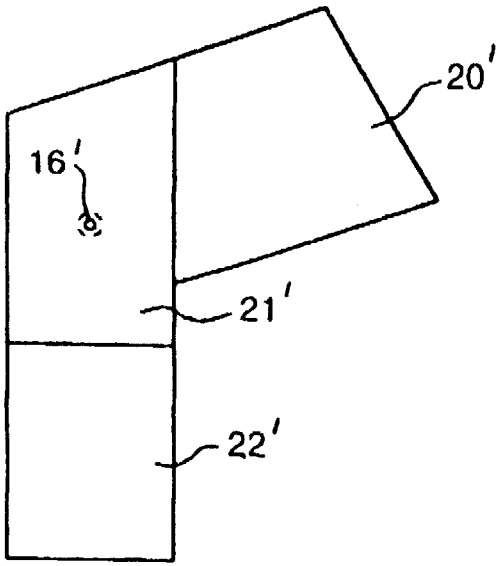
FIG. 8A is a top view of a course assembly for course 1 of the right door jamb of FIG. 6.

FIG. 8A is a top view of a course assembly for course 1 of the right door jamb of FIG. 6, FIG. 8B is a top view of a course assembly for course 3, and FIG. 9 is a top view of a course assembly for courses 2 and 4 of the right door jamb of FIG. 6. It will be observed that except for being of opposite hand configuration, the courses of FIGS. 8A and 8B are identical to those of FIGS. 4A and 4B and the courses of FIG. 9 are identical to those of FIG. 5. Accordingly, their identifying symbols are similar except for the prime markers that have been added to corresponding parts in FIGS. 8A, 8B and 9.

Figure 10:
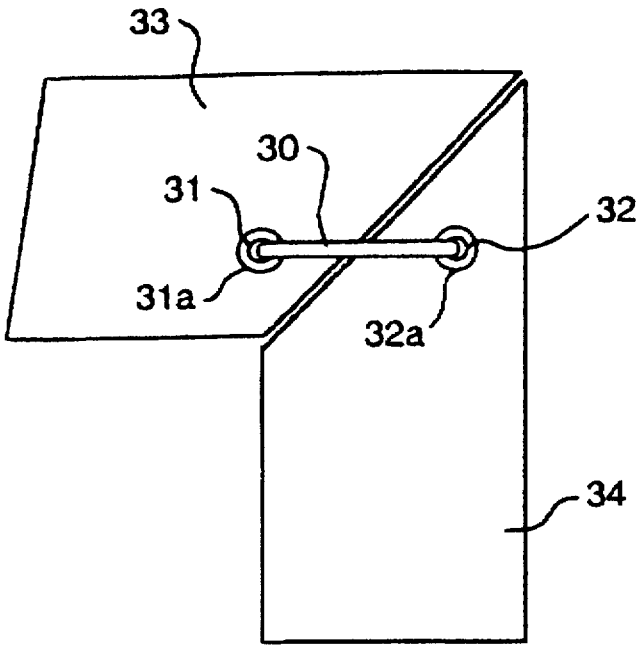
FIG. 10 is a top view of an alternate course assembly in which there is included an auxiliary metal strap.

Now turning to FIG. 10, it will be seen to illustrate a top view of an alternate course assembly in which there is included an auxiliary metal strap 30 that at its ends is affixed to metallic rods 31 and 32. Rods 31 and 32 are fitted with collars 31*a* and 32*a* through which compressive retaining forces may be imparted to the refractories 33 and 34 to add strength to the assembly and assist in retaining the refractories in place. Rods 31 and 32 extend through apertures that preferably are drilled through refractories 33 and 34.

Figure 11:
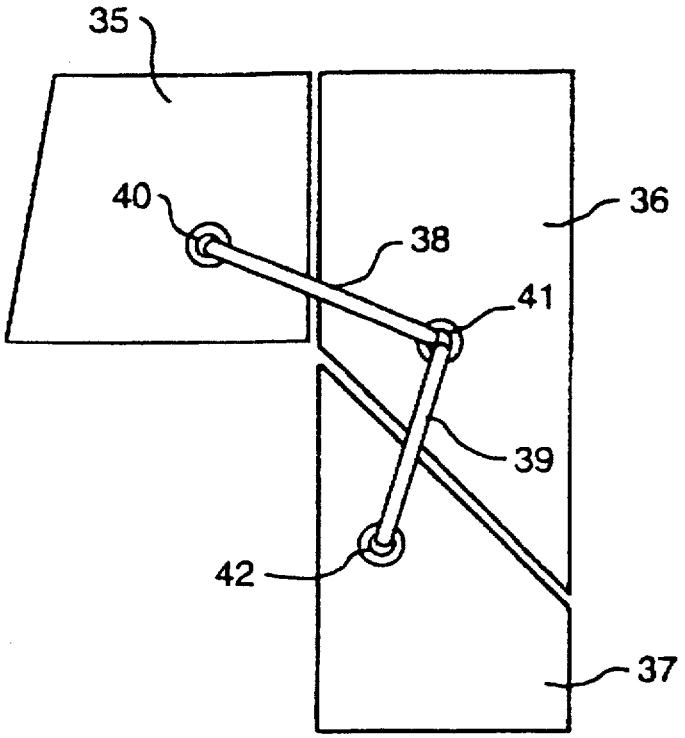
FIG. 11 is a top view of another alternate course assembly in which there is included an auxiliary metal strap.

FIG. 11 depicts a course assembly similar to that of FIG. 10 except including an additional refractory shape. There, in FIG. 11 there are shown shapes 35, 36 and 37 which are fastened together with metallic straps 38 and 39. The course assembly of FIG. 11 includes metal rods 40, 41 and 42 which, together with optional collars 40*a*, 41*a* and 42*a* lock straps 38 and 39 into position as shown. The metal rods 40, 41 and 42 may extend downwardly to engage conventional floor anchors as mentioned above.

The geometry of the brick in FIG. 10 is different from those of the previous illustrations. The brick shape, and the angle between jamb and side-wall brick will vary depending upon furnace size and design.

It should be noted that, as mentioned above, one or more of the foregoing refractory shapes may be wholly or partly covered with an exterior of metal which may be used to fasten such shape to the aforementioned exterior shell such as by welding.

It should also be noted that the door jamb assemblies may be partly or wholly pre-fabricated, with the aforementioned steel rods being employed to retain individual refractory shapes together in the desired configurations.

It will now be evident that there have been described herein improved refractory door jamb constructions that provide increased strength and resistance to dislodgement from impact.

Although the inventions hereof have been described by way of a preferred embodiment, it will be evident that other adaptations and modifications may be employed without departing from the spirit and scope thereof.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. An interconnected refractory brick door jamb assembly for an electric arc steel furnace comprising:

(a) a left door jamb assembly and a right door jamb assembly;

(b) each of said left and right door jamb assemblies comprising a plurality of courses of refractory bricks disposed in successive layers, a brick in each selected course having an aperture therethrough; apertures in successive ones of said selected courses being in axial alignment; and (c) a pair of rods, one of said rods extending within said apertures of said refractory bricks of said left door jamb assembly for strengthening said left door jamb assembly; and another of said rods extending within said apertures of said refractory bricks of said right door jamb assembly for strengthening said right door jamb assembly.

2. An interconnected refractory brick door jamb assembly according to claim 1 in which said selected courses comprise all of said courses.

3. An interconnected refractory brick door jamb assembly according to claim 1 in which said courses of refractory bricks are:

(a) disposed vertically;

(b) in which uppermost apertured bricks in each of said left and right door jamb assemblies include an exposed surface; and (c) in which said uppermost apertured bricks include recesses contiguous and in axial alignment with apertures within said uppermost apertured bricks.

4. An interconnected refractory brick door jamb assembly according to claim 2 in which said courses of refractory bricks are:

(a) disposed vertically;

(b) in which uppermost apertured bricks in each of said left and right door jamb assemblies include an exposed surface; and (c) in which said uppermost apertured bricks include recesses contiguous and in axial alignment with apertures within said uppermost apertured bricks.

5. An interconnected refractory brick door jamb assembly according to claim 1 wherein said rods are metallic.

6. An interconnected refractory brick door jamb assembly according to claim 1 wherein said rods are ferrous.

7. An interconnected refractory brick door jamb assembly according to claim 1 in which said rods are steel.

8. An interconnected refractory brick door jamb assembly according to claim 1 further including means for anchoring said rods into a desired predetermined location.

9. An interconnected refractory brick door jamb assembly according to claim 7 further including means for anchoring said rods into a desired predetermined location.

10. An interconnected refractory brick door jamb assembly according to claim 9 in which said means for anchoring said rods into a desired predetermined location comprises floor anchors.

11. An interconnected refractory brick door jamb assembly according to claim 1 wherein successive contiguous layers of refractory bricks are of differing geometries.

12. An interconnected refractory brick door jamb assembly according to claim 7 wherein successive contiguous layers of refractory bricks are of differing geometries.

13. An interconnected refractory brick door jamb assembly according to claim 10 wherein successive contiguous layers of refractory bricks are of differing geometries.

14. An interconnected refractory brick door jamb assembly according to claim 1 further including metallic members for imparting compressive forces to selected ones of said bricks.

15. An interconnected refractory brick door jamb assembly according to claim 14 in which said metallic members are steel plates.

16. An interconnected refractory brick door jamb assembly according to claim 14 wherein said metallic members are metallic straps.

17. An interconnected refractory brick door jamb assembly according to claim 1 wherein said left door jamb assembly and said right door jamb assembly each have two sides, one of said sides of each said left and right door jamb assembly being planar, and another of said sides of each said left and right door jamb assembly being non planar.

18. An interconnected refractory brick door jamb assembly according to claim 3 wherein said left door jamb assembly and said right door jamb assembly each have two sides, one of said sides of each said left and right door jamb assembly being planar, and another of said sides of each said left and right door jamb assembly being non planar.

19. An interconnected refractory brick door jamb assembly according to claim 10 wherein said left door jamb assembly and said right door jamb assembly each have two sides, one of said sides of each said left and right door jamb assembly being planar, and another of said sides of each said left and right door jamb assembly being non planar.

20. A method of making an interconnected refractory brick door jamb assembly for an electric arc steel furnace comprising:

(a) laying up a left door jamb assembly and a right door jamb assembly each assembly having a plurality of courses of refractory bricks;

(b) disposing said courses vertically in successive layers;

(c) drilling aligned apertures within bricks in selected courses of said left door jamb assembly and said right door jamb assembly to produce an aperture extending vertically and in axial alignment through said selected courses of each said left door jamb assembly and said right door lamb assembly; and (d) installing a first steel rod within said aperture of said left door jamb assembly and a second steel rod within said apertures of said right door jamb assembly.

21. The method according to claim 20 further including a step of tightening said first and said second steel rods to apply compressive forces to said left and right door jamb assemblies.

22. A method of making an interconnected refractory brick door jamb assembly for an electric arc steel furnace comprising:

(a) laying up a left door jamb assembly and a right door jamb assembly each having a plurality of courses of refractory bricks;

(b) disposing said courses vertically in successive layers;

(c) drilling aligned apertures within bricks in selected courses of said left door jamb assembly and said right door jamb assembly to produce an aperture extending vertically and in axial alignment through said selected courses of each said left door jamb assembly and said right door jamb assembly;

(d) inserting a first steel rod within said aperture of said left door jamb assembly and a second steel rod within said apertures of said right door jamb assembly; and (e) anchoring said first and second steel rods to an anchoring support.

23. The method according to claim 22 further including a step of tightening said first and said second steel rods to apply compressive forces to said left and right door jamb assemblies.

* * * * *